US009263213B2

(12) United States Patent
Mori et al.

(10) Patent No.: US 9,263,213 B2
(45) Date of Patent: Feb. 16, 2016

(54) POWER SWITCHING CONTROL DEVICE AND CLOSING CONTROL METHOD THEREOF

(75) Inventors: Tomohito Mori, Chiyoda-ku (JP); Daigo Matsumoto, Chiyodu-ku (JP); Hiroyuki Tsutada, Chiyoda-ku (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 511 days.

(21) Appl. No.: 13/881,192

(22) PCT Filed: Jan. 12, 2011

(86) PCT No.: PCT/JP2011/050356

§ 371 (c)(1),
(2), (4) Date: Apr. 24, 2013

(87) PCT Pub. No.: WO2012/095958

PCT Pub. Date: Jul. 19, 2012

(65) Prior Publication Data

US 2013/0221760 A1 Aug. 29, 2013

(51) Int. Cl.

| | |
|---|---|
| ***H01H 47/00*** | (2006.01) |
| ***H01H 35/00*** | (2006.01) |
| ***H01H 9/56*** | (2006.01) |

(52) U.S. Cl.

CPC ..... *H01H 35/00* (2013.01); *H01H 9/563* (2013.01); *Y10T 307/858* (2015.04)

(58) Field of Classification Search

CPC ..... H01H 35/00; H01H 9/563; Y10T 307/858
See application file for complete search history.

(56) References Cited

U.S. PATENT DOCUMENTS

| | | | |
|---|---|---|---|
| 5,563,459 | A | 10/1996 | Kurosawa et al. |
| 7,095,139 | B2 | 8/2006 | Tsutada et al. |
| 7,711,502 | B2 | 5/2010 | Koyama et al. |
| 7,787,228 | B2 | 8/2010 | Koyama et al. |
| 7,936,549 | B2 | 5/2011 | Takeuchi et al. |
| 2004/0124814 | A1 | 7/2004 | Tsutada et al. |
| 2008/0164962 | A1 | 7/2008 | Koyama et al. |
| 2008/0269952 | A1 | 10/2008 | Tsutada et al. |
| 2010/0141050 | A1 | 6/2010 | Saito et al. |

FOREIGN PATENT DOCUMENTS

| | | | |
|---|---|---|---|
| JP | 3-27725 | A | 2/1991 |
| JP | 3-156820 | A | 7/1991 |
| JP | 2003-168335 | A | 6/2003 |
| JP | 2004-208394 | A | 7/2004 |
| JP | 2008-135246 | A | 6/2008 |
| JP | 2008-277129 | A | 11/2008 |

OTHER PUBLICATIONS

Canadian Office Action dated Jan. 28, 2015 issued in corresponding Canadian Patent Appln. No. 2,823,234 (7 pages).

International Search Report (PCT/ISA/210) issued on Mar. 8, 2011, by the Japanese Patent Office as the International Searching Authority for International Application No. PCT/JP2011/050356.

Written Opinion (PCT/ISA/237) issued on Mar. 8, 2011, by the Japanese Patent Office as the International Searching Authority for International Application No. PCT/JP2011/050356.

*Primary Examiner* — Daniel Cavallari

(74) *Attorney, Agent, or Firm* — Buchanan Ingersoll & Rooney PC

(57) ABSTRACT

A power switching control device and a closing control method thereof that can suppress generation of a transient voltage or current that is possibly caused by a variation in a load-side voltage after interrupting a current are obtained. A circuit-breaker-gap-voltage estimate value at and after a present time is calculated based on a power-supply-side voltage estimate value and a load-side voltage estimate value at and after the present time, a target closing-time domain from a closing controllable time to a closing control limit time in which a circuit breaker can be closed at a timing when an absolute value of the circuit-breaker-gap-voltage estimate value falls within a preset allowable range is calculated based on this circuit-breaker-gap-voltage estimate value, and the closing controllable time is delayed by a preset delay time in a case of a subsequent closing phase of a second or later closing phase.

18 Claims, 3 Drawing Sheets

POWER SWITCHING CONTROL DEVICE AND CLOSING CONTROL METHOD THEREOF

FIELD

The present invention relates to a power switching control device and a closing control method thereof.

BACKGROUND

Generally, it is necessary for a power switching control device to appropriately control a closing timing of a power switching device such as a circuit breaker and to suppress generation of a transient voltage or current at a time of closing the circuit breaker.

A technology related to a conventional power switching control device is disclosed as follows. The power switching control device creates a target closing-phase map in view of pre-arc characteristics and mechanical-motion variation characteristics of a circuit breaker and amplitude variations in a load-side voltage of the circuit breaker. Furthermore, the power switching control device calculates a target closing-time sequence from frequencies and phases of the power-supply side voltage and the load-side voltage of the circuit breaker while referring to the target closing-phase map. When a closing command is input, the power switching control device controls a timing of outputting a closing control signal based on a predicted closing time and the target closing time sequence. Generation of the transient voltage or current at the time of closing the circuit breaker is thereby suppressed (for example, Patent Literature 1).

CITATION LIST

Patent Literature

Patent Literature 1: Japanese Patent Application Laid-open No. 2008-277129

SUMMARY

Technical Problem

The conventional technology mentioned above is adopted on an assumption that the behavior of the load-side voltage does not change after interrupting a current. However, in a case of closing the circuit breaker for each phase, the load-side voltage of the circuit breaker often varies in second and third closing phases by the influence of the circuit breaker closed in the first closing phase. If such a variation occurs to the load-side voltage, a circuit-breaker-gap-voltage estimate value estimated right after interrupting the current does possibly not match an actual circuit-breaker gap-voltage in the second and third closing phases after closing the circuit breaker in the first closing phase. Accordingly, according to the conventional technique, even if the power switching control device controls the circuit breaker to be closed at a target closing time calculated based on the circuit-breaker-gap-voltage estimate value estimated right after interrupting the current, it is disadvantageously and often impossible to close the circuit breaker within a circuit-breaker gap-voltage range assumed in advance and to sufficiently suppress generation of a transient voltage or current at the time of closing the circuit breaker.

The present invention has been achieved in view of the above problems, and an object of the present invention is to provide a power switching control device and a closing control method thereof capable of suppressing generation of a transient voltage or current that is possibly caused by a variation in a load-side voltage after interrupting a current.

Solution to Problem

In order to solve above-mentioned problems and achieve the object of the present invention, there is provided a power switching control device comprising: a voltage measurement unit that measures a power-supply side voltage an a load-side voltage of a circuit breaker; a voltage estimation unit that estimates a power-supply-side voltage estimate value at and after a present time based on the power-supply side voltage for a period of a past constant time, and that estimates a load-side voltage estimate value at and after the present time based on the load-side voltage for the period of the past certain time; a target closing-time calculation unit that calculates a circuit-breaker-gap-voltage estimate value at and after the present time based on the power-supply-side voltage estimate value and the load-side voltage estimate value, that determines a closing order, and that calculates a target closing-time domain from a closing controllable time to a closing control limit time based on the circuit-breaker-gap-voltage estimate value and the closing order, the target closing-time domain being a time domain in which the circuit breaker can be closed at a timing when an absolute value of the circuit-breaker-gap-voltage estimate value falls within a preset allowable range; and a closing control unit that controls the circuit breaker to be closed in the target closing-time domain, wherein the target closing-time calculation unit delays the closing controllable time by a preset predetermined delay time in expectation of a variation in a circuit-breaker gap voltage due to closing of the circuit breaker in a preceding closing phase in a case where the closing order is a subsequent closing phase that is a second or later closing phase when calculating the target closing-time domain.

Advantageous Effects of Invention

According to the present invention, it is possible to suppress generation of a transient voltage or current that is possibly caused by a variation in a load-side voltage after interrupting a current.

DESCRIPTION OF EMBODIMENTS

A power switching control device and a closing control method thereof according to embodiments of the present invention will be explained below in detail with reference to the accompanying drawings. The present invention is not limited to the embodiments.

First Embodiment

Figure 1:
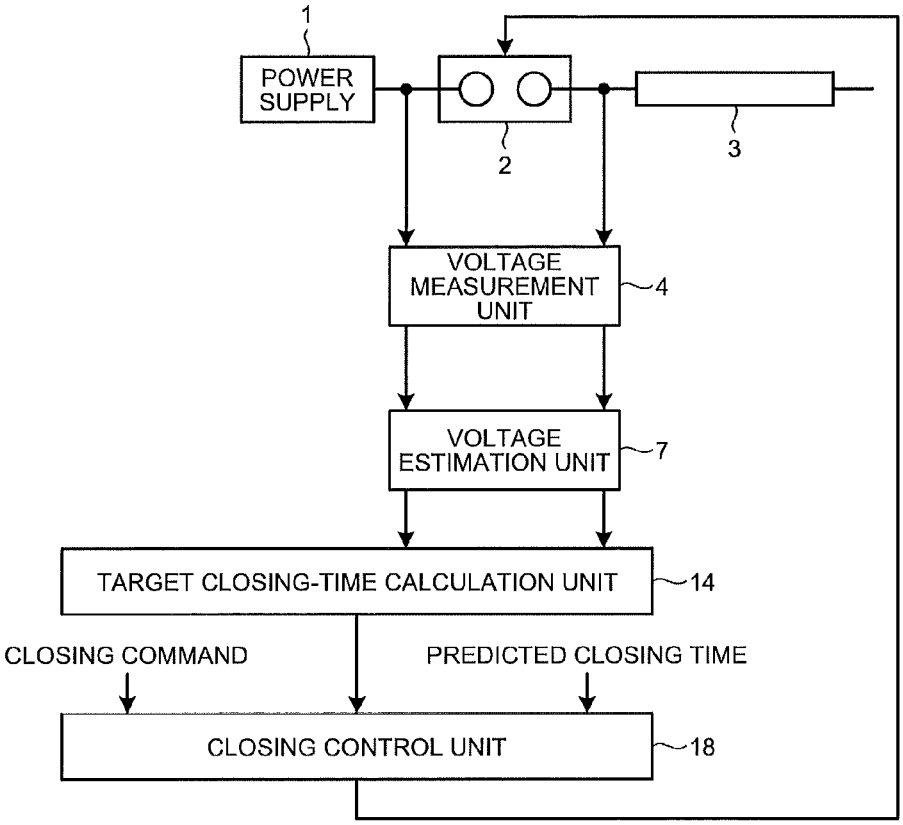
FIG. 1 is a configuration example of a power switching control device according to a first embodiment.

FIG. 1 is a configuration example of a power switching control device according to a first embodiment. In FIG. 1, a circuit breaker 2 serving as a power switching device is connected between a power supply 1 on a left side thereof and a power transmission line 3 on a right side thereof. In the example shown in FIG. 1, for example, the power transmission line 3 is a shunt-reactor-compensated power transmission line or a shunt-reactor-uncompensated power transmission line. When the power transmission line 3 is the shunt-reactor-compensated power transmission line, an AC voltage having a constant frequency due to a reactor on the load side of the circuit breaker 2 and an electrostatic capacity of the power transmission line 3 is generated on a load side of the circuit breaker 2. When the power transmission line 3 is the shunt-reactor-uncompensated power transmission line, a DC voltage in proportion to a power-supply side voltage at a time of interrupting a current is generated on the load side of the circuit breaker 2. In the example shown in FIG. 1, only one phase among three phases, that is, a phase A, a phase B, and a phase C, is shown for the brevity of explanations.

The power switching control device according to the first embodiment includes a voltage measurement unit 4, a voltage estimation unit 7, a target closing-time calculation unit 14, and a closing control unit 18.

The voltage measurement unit 4 measures the power-supply side voltage of the circuit breaker 2, stores therein the power-supply side voltage measured for a certain time's period, and outputs the power-supply side voltage to the voltage estimation unit 7. The voltage measurement unit 4 also measures the load-side voltage of the circuit breaker 2, stores therein the load-side voltage for the certain time's period, and outputs the load-side voltage to the voltage estimation unit 7.

The voltage estimation unit 7 estimates a power-supply-side voltage estimate value at and after the present time based on the power-supply side voltage output from the voltage measurement unit 4 for a certain period from the present time to the past, and outputs the power-supply-side voltage estimate value to the target closing-time calculation unit 14. In addition, the voltage estimation unit 7 estimates a load-side voltage estimate value at and after the present time based on the load-side voltage outputs from the voltage measurement unit 4 for the certain period from the present time to the past, and outputs the load-side voltage estimate value to the target closing-time calculation unit 14.

An example of a method of calculating the power-supply-side voltage estimate value and the load-side voltage estimate value at and after the present time is described. It is assumed here that each of the power-supply side voltage and the load-side voltage is referred to as "voltage signal", and that each of the power-supply-side voltage estimate value and the load-side voltage estimate value is referred to as "voltage-signal estimate value".

In a case where the voltage signal is an AC waveform signal, as for a frequency of a voltage-signal estimate value, for example, it suffices to obtain an average value of a plurality of zero-point time intervals of the voltage signal, to multiply a reciprocal of the average value of the zero-point time intervals by ½, and to set a resultant value as the frequency of the voltage-signal estimate value. The frequency of the power-supply-side voltage estimate value can be set to either 50 hertz or 60 hertz, depending on system conditions. As for a phase of the voltage-signal estimate value, for example, the latest zero-point time when the voltage signal changes from a minus sign to a plus sign among a plurality of zero-point times of the voltage signal is stored as time of a phase of 0 degree. In addition, the latest zero-point time when the voltage signal changes from the plus sign to the minus sign is stored as a time of a phase of 180 degrees among a plurality of zero-point times of the voltage signal. As for an amplitude of the voltage signal estimate value, a maximum value and a minimum value of a plurality of voltage signals obtained for a period, for example, from a current interruption time to the present time are stored, and an average of absolute values of the stored maximum and minimum values is set as the amplitude of the voltage-signal estimate value. Alternatively, the amplitude of the voltage-signal estimate value can be obtained by integrating the voltage signals by a cycle to obtain an effective value and by multiplying the effective value by $\sqrt{2}$. When the above calculated values are used, the voltage-signal estimate value can be approximated to "amplitude×sin(2π×frequency×t)", where a time corresponding to the phase of 0 degree is assumed as t=0.

When the voltage signal is a DC signal, the voltage-signal estimate value can be calculated by using a conventional technique. However, because this calculation method is a complicated method, explanations thereof will be omitted.

The target closing-time calculation unit 14 calculates a target closing-time domain based on the power-supply-side voltage estimate value and the load-side voltage estimate value output from the voltage estimation unit 7, and outputs the calculated target closing-time domain to the closing control unit 18.

When a closing command is input to the closing control unit 18, the closing control unit 18 outputs a closing control signal in a time domain earlier than the target closing-time domain output from the target closing-time calculation unit 14 by as much as a predicted closing time.

The predicted closing time means a predicted value of a closing time since the closing control signal is output to the circuit breaker 2 until contacts of the circuit breaker 2 mechanically contact each other. A variation in the closing time of the circuit breaker 2 can be divided into a part that depends on such environmental conditions as an environmental temperature, a control voltage, and an operational pressure and of which a variation time correction common to circuit breakers of the same type can be made, and a part that varies depending on individual state changes of the circuit breakers such as contact wearing, a temporal change, and a minute individual difference and that is necessary to correct individually. That is, the predicted closing time at next closing can be obtained by making corrections by the use of the first corrected time based on the environmental conditions such as the environmental temperature, the control voltage, and the operational pressure and the second corrected time based on a past operation history.

Specifically, a reference closing time that is an average value of the closing time is measured in advance under conditions of a certain environmental temperature, a certain control voltage, and a certain operational pressure. Furthermore, average values of the closing time when closing the circuit breaker 2 while changing the environmental temperature, the control voltage, and the operational pressure are stored in a table as differential values from the reference closing time. During an operation, the closest value in the table is interpolated based on an actual environmental temperature, an actual control voltage, and an actual operational pressure, thereby calculating the first corrected time based on the environmental conditions. Furthermore, errors between an actual closing time and the predicted closing time during the operation of the circuit breaker 2 for past n times (past ten times, for example) are obtained, and a weight is added to each of the errors, thereby calculating the second corrected time based on the past operation history. Using the above calculated values, the predicted closing time can be calculated as expressed by "predicted closing time" "reference closing time" +"first corrected time" +"second corrected time".

A setting example of the target closing-time domain by the target closing-time calculation unit 14 in the power switching control device according to the first embodiment is explained next with reference to FIGS. 2 and 3.

Figure 2:
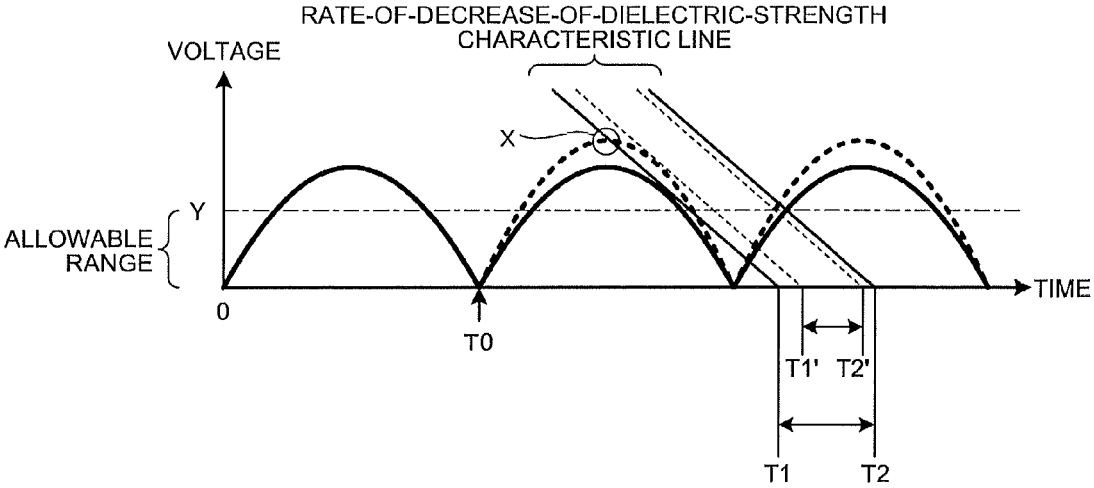
FIG. 2 is an explanatory diagram of a setting example of a target closing-time domain.

FIG. 2 is an explanatory diagram of a setting example of the target closing-time domain. A line indicated as a solid line in FIG. 2 depicts a waveform of an absolute value of a circuit-breaker gap voltage after interrupting the current. A line indicated as a dashed line in FIG. 2 depicts a waveform of an absolute value of the circuit-breaker gap voltage in subsequent closing phases of the second and later closing phases in a case where the circuit breaker 2 is closed earlier in the other preceding phase at a time T0. FIG. 2 is a setting example of the target closing-time domain so as to close the circuit breaker 2 at a timing when the absolute value of the circuit-breaker gap voltage falls within a range from 0 to Y.

In a process of closing the circuit breaker 2, an inter-pole dielectric strength decreases as a distance between contact poles decreases. At a time point at which this dielectric strength is equal to or lower than an electric field generated by the voltage applied between the contact poles, a preceding arc following a dielectric breakdown between the contact poles is generated and the circuit breaker 2 is electrically closed. That is, the circuit breaker 2 is closed at an intersection between the waveform of the absolute value of the circuit-breaker gap voltage and an Rate of Decrease of Dielectric Strength (RDDS) characteristic line between the contact poles of the circuit breaker 2 in the process of closing the circuit breaker 2. In the example indicated by the solid line shown in FIG. 2, it suffices to set a range from a time T1 to a time T2 shown in FIG. 2 as the target closing-time domain so as to close the circuit breaker 2 at the timing when the absolute value of the circuit-breaker gap voltage falls in the range from 0 to Y. In the following explanations, the time T1 in the target closing-time domain is referred to as "closing controllable time" and the time T2 is referred to as "closing control limit time".

On the other hand, as indicated by the dashed line shown in FIG. 2, in the case of the subsequent closing phases of the second and later closing phases, a variation in a load-side voltage caused by closing of the circuit breaker 2 in the preceding closing phase possibly causes an increase in the circuit-breaker gap voltage. In this case, when the range from the time T1 to the time T2 is set as the target closing-time domain, a preceding arc is possibly generated and the circuit breaker 2 is possibly closed at, for example, an intersection X between the RDDS characteristic line and the absolute value of the circuit-breaker gap voltage, at which the circuit breaker 2 is closed at the time T1. Therefore, in the case of the subsequent closing phases of the second and later closing phases, it is necessary to set a range from a time T1' to a time T2' narrower than the range from the time T1 to the time T2 as the target closing-time domain.

Figure 3:
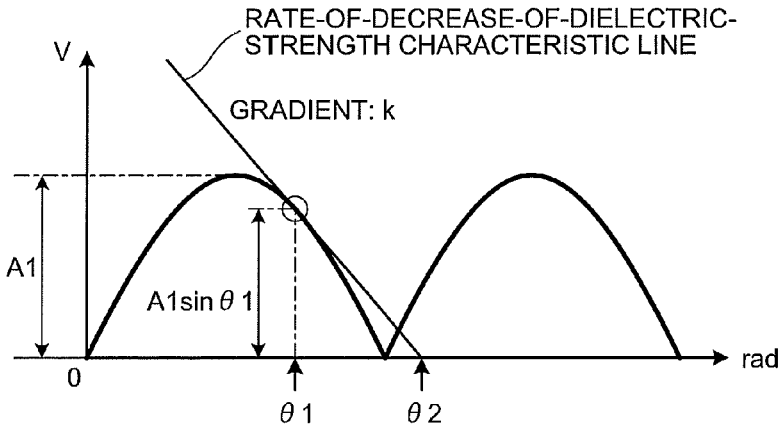
FIG. 3 is an explanatory diagram of an example of a change in a closing controllable time in a case where a circuit-breaker gap voltage differs.

FIG. 3 is an explanatory diagram of an example of a change in the closing controllable time in a case where the circuit-breaker gap voltage differs. As shown in FIG. 3, when the absolute value of the circuit-breaker gap voltage having a peak A1 contacts the RDDS characteristic line having a gradient of k (PU/rad) in a phase θ1, and a phase when the RDDS characteristic line intersects a horizontal axis is assumed as θ2, the following Equations (1) and (2) are obtained. Note that a peak of a rated power-supply side voltage is 1 PU.

$$k(\text{PU/rad})=A1\cos\theta1 \quad (1)$$

$$k(\theta2-\theta1)=-A1\sin\theta1 \quad (2)$$

The following Equations (3) and (4) are derived from the above Equations (1) and (2).

$$\theta1=\cos^{-1}(k/A1) \quad (3)$$

$$\theta2=\theta1-(A/k)\sin\theta1 \quad (4)$$

For example, when it is assumed that k=−0.5 (PU/rad) and the above Equations (3) and (4) are reduced in a case of A1=1 (PU), θ1 and θ2 are expressed as follows.

$$\theta1=\cos^{-1}(-0.5)\approx2.0944\ (\text{rad})\approx120\ (\text{degrees})$$

$$\theta2\approx2.0944\ (\text{rad})+2\sin(2.0944\ (\text{rad}))$$

$$\approx3.8264\ (\text{rad})\approx219\ (\text{degrees})$$

On the other hand, if the above Equations (3) and (4) are reduced in a case of A1=1.2 (PU), θ1 and θ2 are expressed as follows.

$$\theta1\approx\cos^{-1}(-0.4167)\approx2.0006\ (\text{rad})\approx115\ (\text{degrees})$$

$$\theta2\approx2.0006\ (\text{rad})+2\sin\{2.0006\ (\text{rad})\}$$

$$\approx4.1823\ (\text{rad})\approx240\ (\text{degrees})$$

That is, when the peak A1 of the absolute value of the circuit-breaker gap voltage varies from 1 to 1.2, it is necessary to set a time of a phase delayed by 240 (degrees)−219 (degrees)=21 (degrees) as the closing controllable time. In the above example, when a system frequency (a frequency of a power-supply side voltage) is 60 hertz, it suffices to delay the closing controllable time by about 1 millisecond.

Therefore, in the case of the subsequent closing phases of the second and later closing phases, the power switching control device according to the first embodiment controls the closing controllable time to be delayed by a preset predetermined delay time in expectation of an increase in the circuit-breaker gap voltage due to the variation in the load-side voltage as a result of the closing of the circuit breaker 2 in the preceding closing phase. With this control, it is possible to suppress generation of a transient voltage or current that is possibly caused by the variation in the load-side voltage after interrupting the current.

An operation performed by the target closing-time calculation unit 14 according to the first embodiment is described next with reference to FIGS. 1 to 3. An allowable range of the absolute value of the circuit-breaker gap voltage at the time of closing the circuit breaker and the delay time by which the closing controllable time in the subsequent closing phases of the second and later phases is delayed from the closing controllable time in the preceding closing phase are set to the target closing-time calculation unit 14 in advance.

First, the target closing-time calculation unit 14 calculates a circuit-breaker-gap-voltage estimate value at and after the present time based on the power-supply-side voltage estimate value and the load-side voltage estimate value. Furthermore, the target closing-time calculation unit 14 calculates the target closing-time domain in which the circuit breaker 2 can be closed at a timing when an absolute value of the circuit-breaker-gap-voltage estimate value falls within the preset allowable range based on this circuit-breaker-gap-voltage estimate value. In a case of the first closing phase, the target closing-time calculation unit 14 outputs the target closing-time domain calculated here to the closing control unit 18.

On the other hand, in the case of the subsequent closing phases of the second and later closing phases, the target closing-time calculation unit 14 sets a new target closing-time domain delayed from the target closing-time domain set in the case of the first closing phase by the preset delay time, and outputs the new target closing-time domain to the closing control unit 18.

As described above, according to the power switching control device and the closing control method thereof of the first embodiment, the circuit-breaker-gap-voltage estimate value at and after the present time is calculated based on the power-supply-side voltage estimate value and the load-side voltage estimate value at and after the present time, the target closing-time domain from the closing controllable time to the closing control limit time in which the circuit breaker can be closed at the timing when the absolute value of the circuit-breaker-gap-voltage estimate value falls within the preset allowable range is calculated based on this circuit-breaker-gap-voltage estimate value, and the closing controllable time is delayed by the preset delay time in the case of the subsequent closing phases of the second and later closing phases. Therefore, it is possible to suppress the generation of a transient voltage or current that is possibly caused by the variation in the load-side voltage after interrupting the current.

In the first embodiment described above, the closing controllable time is delayed by the preset delay time in the case of the subsequent closing phases of the second and later closing phases. Alternatively, the case of the subsequent closing phases can be divided into a case of the second closing phase and a case of the third closing phase, and an optimum delay time different between those cases can be set.

Furthermore, in the case of the subsequent closing phases of the second and later closing phases, it is more effective to advance the closing control limit time by a preset advance time in addition to delaying the closing controllable time in the target closing-time domain by the preset delay time.

Alternatively, the target closing-time domain can be set by setting a maximum variation in the circuit-breaker gap voltage in advance and by calculating the circuit-breaker-gap-voltage estimate value to which the maximum variation is applied in the case of the subsequent closing phases of the second and later closing phases. With this configuration, it is possible to close the circuit breaker at the timing when the absolute value of the circuit-breaker gap voltage falls within the allowable range that is set in advance more accurately, and to appropriately suppress the generation of a transient voltage or current that is possibly caused by the variation in the load-side voltage after interrupting the current.

Second Embodiment

In a second embodiment of the present invention, a closing order after interrupting a current is described. Because configurations of a power switching control device according to the second embodiment are same as those described in the first embodiment and shown in FIG. 1, explanations thereof will be omitted.

Figure 4:
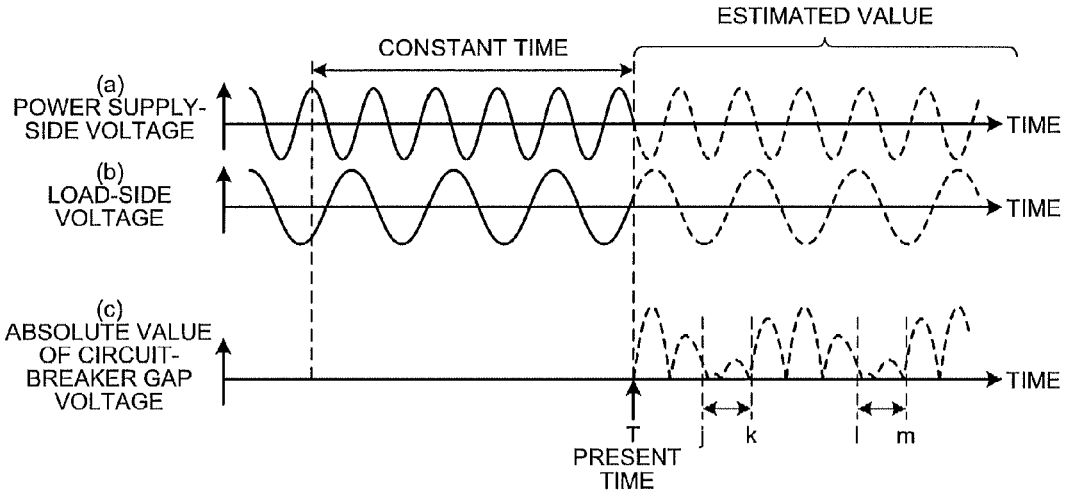
FIG. 4 depict an example of voltage waveforms of respective parts after interrupting a current.

FIGS. 4 depict an example of voltage waveforms of respective parts after interrupting a current. FIG. 4(*a*) depicts a power-supply-side voltage waveform and FIG. 4(*b*) depicts a load-side voltage waveform. FIG. 4(*c*) depicts a waveform of the absolute value of the circuit-breaker gap voltage that is an absolute value of a differential value between the power-supply side voltage and the load-side voltage. For instance, the example shown in FIGS. 4 is a case where the power transmission line 3 is a shunt-reactor-compensated power transmission line.

As described in the first embodiment, the load-side voltage after interrupting the current on the shunt-reactor-compensated power transmission line is the AC voltage having the constant frequency due to the reactor on the load side of the circuit breaker 2 and the electrostatic capacity of the power transmission line 3 as shown in FIG. 4(*b*). The frequency of this load-side voltage normally differs from that of the power-supply side voltage waveform.

Therefore, as shown in FIG. 4(*c*), the waveform of the absolute value of the circuit-breaker-gap-voltage estimate value is a waveform on which a beat-like fluctuation waveform is superimposed as a result of interference between the frequency of the power-supply side voltage waveform and that of the load-side voltage waveform.

When the waveform of the absolute value of the circuit-breaker gap voltage is the beat-like waveform, the target closing-time domain is set so that the circuit breaker 2 can be closed in a period from a time j to a time k or from a time 1 to a time m in which a crest value is small in FIG. 4(*c*). With this setting, it is possible to appropriately suppress generation of a transient voltage or current at the time of closing the circuit breaker.

Figure 5:
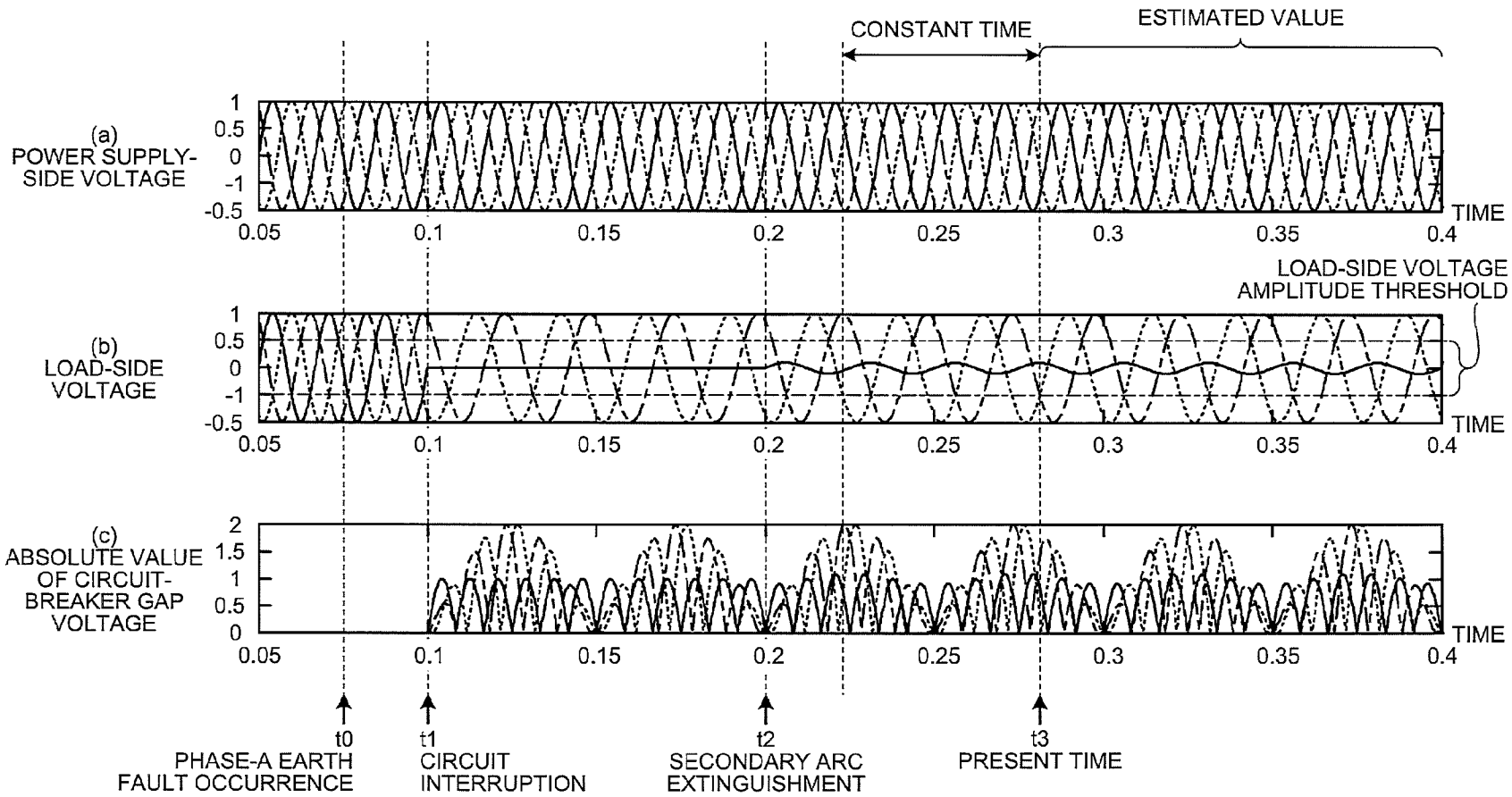
FIG. 5 depict an example of voltage waveforms of respective parts in respective phases before and after a current interruption.

FIGS. 5 depict an example of voltage waveforms of respective parts in respective phases before and after a current interruption. FIG. 5(*a*) depicts power-supply side voltage waveforms and FIG. 5(*b*) depicts load-side voltage waveforms. FIG. 5(*c*) depicts an absolute value of the circuit-breaker gap voltage. In FIGS. 5, voltage levels of the respective voltages on a vertical axis are indicated with the peak of the rated power-supply side voltage set as 1 PU. Furthermore, on the voltage waveforms of the respective parts shown in FIGS. 5, a line indicated as a solid line shows a voltage waveform of each part in the phase A, a line indicated as a dashed line shows a voltage waveform of each part in the phase B, and a line indicated as a chain line shows a voltage waveform of each part in the phase C. In the example shown in FIGS. 5, a phase-A earth fault occurs at a time t0, the current is interrupted at a time t1, and a secondary arc is extinguished, that is, the phase-A earth fault is extinguished at a time t2. Similarly to the example shown in FIGS. 4, for instance, the example shown in FIGS. 5 is a case where the power transmission line 3 is a shunt-reactor-compensated power transmission line.

As shown in FIG. 5(*c*), the waveform of the absolute value of the circuit-breaker gap voltage in the phase A is smaller in the crest value of the fluctuation waveform in a beat-like waveform than those of the absolute values of the circuit-breaker gap voltages in the phases B and C, and the crest value of the waveform of the absolute value in the phase A transitions with the relatively large crest value. Therefore, in a case of closing the circuit breaker 2 in the phase A earlier than the phases B and C, there is a high probability that the circuit breaker 2 is closed at a timing when the circuit-breaker gap voltage is high. In this case, the variation in the load-side voltage in the subsequent closing phases (the phases B and C in this example) is large. That is, the variation in the circuit-breaker gap voltage in the subsequent closing phases is large, which makes it difficult to suppress the generation of a transient voltage or current at the time of closing the circuit breaker.

Therefore, in the power switching control device according to the second embodiment, the target closing-time calculation unit 14 sets the phase (the phase B or C in the example shown in FIGS. 5) in which the crest value of the absolute value of the circuit-breaker-gap-voltage estimate value is large as the preceding closing phase. With this control, it is possible to reduce the variation in the load-side voltage in the subsequent closing phases that is possibly caused by the closing of the circuit breaker 2 in the preceding closing phase, that is, to reduce the variation in the circuit-breaker gap voltage in the subsequent closing phases. It is also possible to suppress the generation of a transient voltage or current that is possibly caused by the variation in the load-side voltage after interrupting the current.

Furthermore, when the amplitude value of the load-side voltage is low such as that in the phase A shown in FIG. 5(*b*), it is often difficult to obtain the load-side voltage estimate value at and after the present time.

Accordingly, the voltage estimation unit 7 according to the second embodiment sets a load-side voltage amplitude threshold (±0.5 PU in the example shown in FIGS. 5) in advance, and estimates the load-side voltage estimate value as zero when the amplitude of the load-side voltage is equal to or lower than the load-side voltage amplitude threshold.

Furthermore, as in a case of executing slow re-closing for which a time period since a current interruption time or the opening time of the circuit breaker 2 until closing the circuit breaker 2 is longer than a preset predetermined time (by 3 or more seconds, for example), when a sufficient time interval is secured from a current interruption time t1 to the next closing, the load-side voltage attenuates by a time constant or the like that is determined by the electrostatic capacity of the power transmission line 3 and a leakage resistance of an insulator supporting the power transmission line 3 and eventually converges into zero over time.

Therefore, the voltage estimation unit 7 sets a predetermined limit time in advance, and estimates the load-side voltage estimate value as zero when the limit time passes since the circuit-breaker closing time or the opening time similarly to the above case where the amplitude of the load-side voltage is equal to or lower than the load-side voltage amplitude threshold. For example, either a time point at which the gap voltage of the circuit breaker 2 is generated or a time point at which a main circuit current of the circuit breaker 2, which is measured in advance, is equal to zero can be set as a current interruption time. Furthermore, for example, either a time point after the passage of a predetermined opening time since an interruption command for the circuit breaker 2 is output or a time point at which a contact state of the circuit breaker 2 changes from a closed state to an open state while measuring contact open/closed states in advance can be set as the circuit-breaker opening time.

The target closing-time calculation unit 14 sets a preset reference closing-time domain as the target closing-time domain when the load-side voltage estimate value is zero. The closing controllable time and the closing control limit time of this reference closing-time domain can be set so that a zero-point phase (0 or 180 degrees) of the power-supply-side voltage waveform is within a closing phase range. Alternatively, the zero-point phase (0 or 180 degrees) of the power-supply-side voltage waveform is set as a target closing time, and a predetermined domain before and after the target closing time can be set as the reference closing-time domain. The present invention is not limited to the method of setting this reference closing-time domain.

That is, when the amplitude of the load-side voltage is low and equal to or lower than the preset load-side voltage amplitude threshold or when the preset limit time passes since the current interruption time, the power switching control device controls the circuit breaker 2 to be closed in the preset reference closing-time domain without performing any subsequent estimation computation of the circuit-breaker-gap-voltage estimate value. This can simplify a computation process following the calculation of the target closing-time domain.

Furthermore, when the circuit breaker 2 is closed at a longer closing interval of the respective phases, a system open-phase state unfavorably continues. Therefore, the closing interval at which the circuit breaker 2 is closed in the respective phases is set within a preset predetermined interval (a one-cycle interval, for example).

As described above, according to the power switching control device and the closing control method thereof of the second embodiment, the phase in which the crest value of the absolute value of the circuit-breaker-gap-voltage estimate value at and after the present time is large is set as the preceding closing phase so as to reduce the variation in the load-side voltage due to the closing of the circuit breaker in the preceding phase. Therefore, it is possible to suppress the generation of a transient voltage or current that is possibly caused by the variation in the load-side voltage after interrupting the current at the time of closing the circuit breaker in each phase.

Furthermore, the preset reference closing-time domain is set as the target closing-time domain when the amplitude of the load-side voltage is equal to or lower than the preset load-side voltage amplitude threshold or the preset limit time passes since the current interruption time. Therefore, it is possible to simplify the computation process following the calculation of the target closing-time domain.

In the second embodiment described above, the phase in which the crest value of the absolute value of the circuit-breaker-gap-voltage estimate value at and after the present time is large is set as the preceding closing phase. However, it is possible to achieve similar effects by setting the phase in which the amplitude of the load-side voltage estimate value at and after the present time is large as the preceding closing phase.

The configuration described in the above embodiments is only an example of the configuration of the present invention, and it is possible to combine the configuration with other publicly-known technologies, and it is needless to mention that the present invention can be configured while modifying it without departing from the scope of the invention, such as omitting a part of the configuration.

REFERENCE SIGNS LIST

1 power supply
2 circuit breaker
3 power transmission line
4 voltage measurement unit
7 voltage estimation unit
14 target closing-time calculation unit
18 closing control unit

The invention claimed is:

1. A power switching control device comprising:

a voltage measurement unit that measures a power-supply side voltage an a load-side voltage of a circuit breaker;

a voltage estimation unit that estimates a power-supply-side voltage estimate value at and after a present time based on the power-supply side voltage for a period of a past constant time, and that estimates a load-side voltage estimate value at and after the present time based on the load-side voltage for the period of the past certain time;

a target closing-time calculation unit that calculates a circuit-breaker-gap-voltage estimate value at and after the present time based on the power-supply-side voltage estimate value and the load-side voltage estimate value, that determines a closing order, and that calculates a target closing-time domain from a closing controllable time to a closing control limit time based on the circuit-breaker-gap-voltage estimate value and the closing order, the target closing-time domain being a time domain in which the circuit breaker can be closed at a timing when an absolute value of the circuit-breaker-gap-voltage estimate value falls within a preset allowable range; and a closing control unit that controls the circuit breaker to be closed in the target closing-time domain, wherein the target closing-time calculation unit delays the closing controllable time by a preset predetermined delay time in expectation of a variation in a circuit-breaker gap voltage due to closing of the circuit breaker in a preceding closing phase in a case where the closing order is a subsequent closing phase that is a second or later closing phase when calculating the target closing-time domain.

2. The power switching control device according to claim 1, wherein the target closing-time calculation unit advances the closing control limit time by a preset predetermined advance time in the case where the closing order is the subsequent closing phase that is the second or later closing phase when calculating the target closing-time domain.

3. A power switching control device comprising:

a voltage measurement unit that measures a power-supply side voltage an a load-side voltage of a circuit breaker;

a voltage estimation unit that estimates a power-supply-side voltage estimate value at and after a present time based on the power-supply side voltage for a period of a past constant time, and that estimates a load-side voltage estimate value at and after the present time based on the load-side voltage for the period of the past certain time;

a target closing-time calculation unit that calculates a circuit-breaker-gap-voltage estimate value at and after the present time based on the power-supply-side voltage estimate value and the load-side voltage estimate value, that determines a closing order, and that calculates a target closing-time domain from a closing controllable time to a closing control limit time based on the circuit-breaker-gap-voltage estimate value and the closing order, the target closing-time domain being a time domain in which the circuit breaker can be closed at a timing when an absolute value of the circuit-breaker-gap-voltage estimate value falls within a preset allowable range; and a closing control unit that controls the circuit breaker to be closed in the target closing-time domain, wherein the target closing-time calculation unit estimates the circuit-breaker-gap-voltage estimate value by applying a circuit-breaker-gap-voltage maximum variation preset in expectation of a variation in a circuit-breaker gap voltage due to closing of the circuit breaker in a preceding closing phase in a case where the closing order is a subsequent closing phase that is a second or later closing phase when estimating the circuit-breaker-gap-voltage estimate value.

4. The power switching control device according to claim 1, wherein the target closing-time calculation unit determines the closing order so as to close the circuit breaker in an order starting at a phase in which a crest value of an absolute value of the circuit-breaker-gap-voltage estimate value is larger when determining the closing order.

5. The power switching control device according to claim 1, wherein the target closing-time calculation unit determines the closing order so as to close the circuit breaker in an order starting at a phase in which an amplitude of the load-side voltage estimate value is higher when determining the closing order.

6. The power switching control device according to claim 1, wherein the target closing-time calculation unit sets a preset reference closing-time domain as the target closing-time domain when the load-side voltage estimate value is zero when calculating the target closing-time domain.

7. The power switching control device according to claim 6, wherein the voltage estimation unit estimates the load-side voltage estimate value as zero when an amplitude of the load-side voltage is equal to or lower than a preset load-side voltage amplitude threshold when estimating the load-side voltage estimate value.

8. The power switching control device according to claim 6, wherein the voltage estimation unit estimates the load-side voltage estimate value as zero when a preset predetermined limit time passes since a current interruption time or an opening time of the circuit breaker when estimating the load-side voltage estimate value.

9. The power switching control device according to claim 1, wherein the target closing-time calculation unit sets a closing interval of respective phases within a preset predetermined interval.

10. A closing control method of a power switching control device, the closing control method comprising:

a first step of measuring a power-supply side voltage an a load-side voltage of a circuit breaker;

a second step of estimating a power-supply-side voltage estimate value at and after a present time on based on the power-supply side voltage for a period of a past constant time;

a third step of estimating a load-side voltage estimate value at and after the present time based on the load-side voltage for the period of the past certain time;

a fourth step of calculating a circuit-breaker-gap-voltage estimate value at and after the present time based on the power-supply-side voltage estimate value and the load-side voltage estimate value, and of determining a closing order;

a fifth step of calculating a target closing-time domain from a closing controllable time to a closing control limit time based on the circuit-breaker-gap-voltage estimate value and the closing order, the target closing-time domain being a time domain in which the circuit breaker can be closed at a timing when an absolute value of the circuit-breaker-gap-voltage estimate value falls within a preset allowable range; and a sixth step of controlling the circuit breaker to be closed in the target closing-time domain, wherein the closing controllable time is delayed by a preset predetermined delay time in expectation of a variation in a circuit-breaker gap voltage due to closing of the circuit breaker in a preceding closing phase in a case where the closing order is a subsequent closing phase that is a second or later closing phase when calculating the target closing-time domain at the fifth step.

11. The closing control method of a power switching control device according to claim 10, wherein the closing control limit time is advanced by a preset predetermined advance time in the case where the closing order is the subsequent closing phase that is the second or later closing phase when calculating the target closing-time domain at the fifth step.

12. A closing control method of a power switching control device, the closing control method comprising:

a first step of measuring a power-supply side voltage an a load-side voltage of a circuit breaker;

a second step of estimating a power-supply-side voltage estimate value at and after a present time based on the power-supply side voltage for a period of a past constant time;

a third step of estimating a load-side voltage estimate value at and after the present time based on the load-side voltage for the period of the past certain time;

a fourth step of calculating a circuit-breaker-gap-voltage estimate value at and after the present time based on the power-supply-side voltage estimate value and the load-side voltage estimate value, and of determining a closing order;

a fifth step of calculating a target closing-time domain from a closing controllable time to a closing control limit time based on the circuit-breaker-gap-voltage estimate value and the closing order, the target closing-time domain being a time domain in which the circuit breaker can be closed at a timing when an absolute value of the circuit-breaker-gap-voltage estimate value falls within a preset allowable range; and a sixth step of controlling the circuit breaker to be closed in the target closing-time domain, wherein the circuit-breaker-gap-voltage estimate value is estimated by applying a circuit-breaker-gap-voltage maximum variation preset in expectation of a variation in a circuit-breaker gap voltage due to closing of the circuit breaker in a preceding closing phase in a case where the closing order is a subsequent closing phase that is a second or later closing phase when estimating the circuit-breaker-gap-voltage estimate value at the fourth step.

13. The closing control method of a power switching control device according to claim 10, wherein the closing order is determined so as to close the circuit breaker in an order starting at a phase in which a crest value of an absolute value of the circuit-breaker-gap-voltage estimate value is larger when determining the closing order at the fourth step.

14. The closing control method of a power switching control device according to claim 10, wherein the closing order is determined so as to close the circuit breaker in an order starting at a phase in which an amplitude of the load-side voltage estimate value is higher when determining the closing order at the fourth step.

15. The closing control method of a power switching control device according to claim 10, wherein a preset reference closing-time domain is set as the target closing-time domain when the load-side voltage estimate value is zero when calculating the target closing-time domain at the fourth step.

16. The closing control method of a power switching control device according to claim 15, wherein the load-side voltage estimate value is estimated as zero when an amplitude of the load-side voltage is equal to or lower than a preset load-side voltage amplitude threshold when estimating the load-side voltage estimate value at the third step.

17. The closing control method of a power switching control device according to claim 15, wherein the load-side voltage estimate value is estimated as zero when a preset predetermined limit time passes since a current interruption time or an opening time of the circuit breaker when estimating the load-side voltage estimate value at the third step.

18. The closing control method of a power switching control device according to claim 10, wherein a closing interval of respective phases is set within a preset predetermined interval at the fourth step.

* * * * *